United States Patent [19]

Penniman et al.

[11] 4,126,402

[45] Nov. 21, 1978

[54] BINDER WITH MAGAZINE STORAGE

[75] Inventors: Richard E. Penniman, Gwynedd Valley; John C. Hensel, Perkasie, both of Pa.

[73] Assignee: Safeguard Products Corporation, North Wales, Pa.

[21] Appl. No.: 839,232

[22] Filed: Oct. 4, 1977

[51] Int. Cl.[2] ..... B42F 13/12

[52] U.S. Cl. ..... 402/53; 402/59

[58] Field of Search ..... 402/53, 51, 59, 58, 402/80 R

[56] References Cited

U.S. PATENT DOCUMENTS

| | | | |
|---|---|---|---|
| 1,169,405 | 1/1916 | Jenkins et al. | 402/59 |
| 2,129,318 | 9/1938 | Emery | 402/59 |

*Primary Examiner*—J. M. Meister

*Attorney, Agent, or Firm*—Seidel, Gonda & Goldhammer

[57] ABSTRACT

A hollow binder for a book having removable pages such as a ledger is used for storage of threaded posts. Each of the posts are threaded to one another and coaxial.

7 Claims, 3 Drawing Figures

BINDER WITH MAGAZINE STORAGE

BACKGROUND

Binders having threaded posts for extending the thickness of a book such as a ledger are old and well known. Heretofore, the extra threaded posts for extending the thickness of the ledger have been supplied separately in an envelope. When a threaded post is needed, the whereabouts of the envelope containing the threaded posts is generally unknown.

It has been proposed in patent 2,129,318 to insert extra threaded posts loosely into a hollow binder. It appears that the threaded posts rattle around within the binder everytime the binder is picked up or moved. Also, the provision of a hollow binder for receiving loose threaded posts as taught by said patent is limited to one specific type of binder and requires the binder to be tilted at an angle so that the posts may be removed. To my knowledge, binders as taught by said patent have not been commercialized.

SUMMARY OF THE INVENTION

The binder of the present invention includes a hollow elongated housing which is closed at opposite ends. One end of the housing is closed by a removable cap. A plurality of posts are connected end to end and are disposed within said housing. One of the posts is connected to said cap so that all posts are removed when said cap is removed. A means is provided on one side face of the housing to which one of said threaded posts may be attached.

It is an object of the present invention to provide a novel binder having a magazine storage for threaded posts in a manner which is simple, reliable, and which overcomes the defects of the prior art concepts.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown a binder with a magazine storage in accordance with the present invention designated generally as 10.

Figure 1:
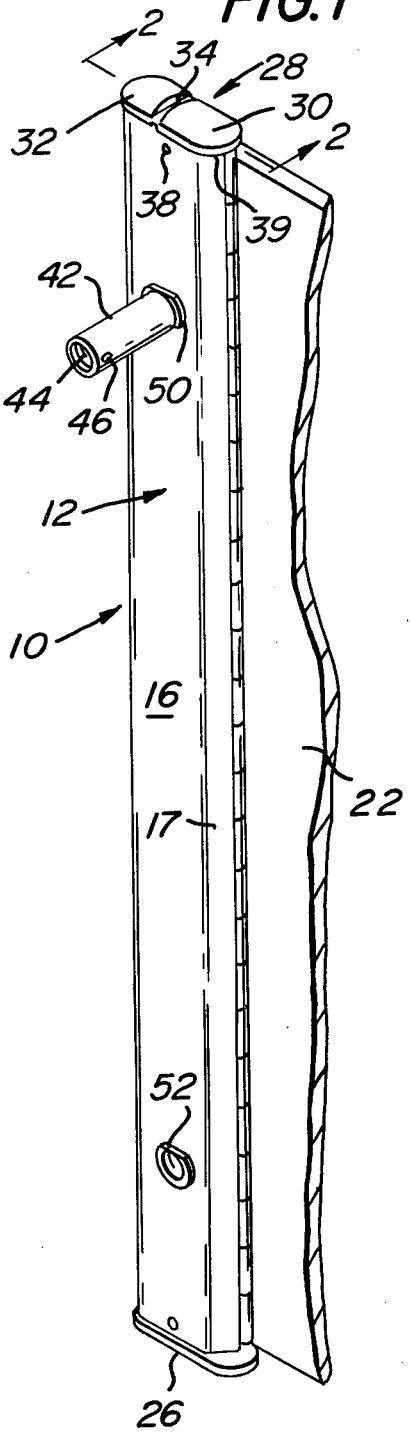
FIG. 1 is a perspective view of the binder housing and a portion of a rear cover.

The binder includes a hollow elongated metal housing 12 having a straight side wall 14 and a straight side wall 16 interconnected by a curved wall 18. Wall 14 is the outer wall of the housing and is wider than wall 16. Wall 16 terminates in an angled wall 17. Wall 14 terminates in spaced hinges 20.

The hinges 20 facilitate coupling the binder to a rear cover 22 by way of a hinge pin 24 or the like. Other equivalent structure may be utilized to facilitate coupling the rear cover 22 to the wall 16 of the housing 12.

Figure 2:
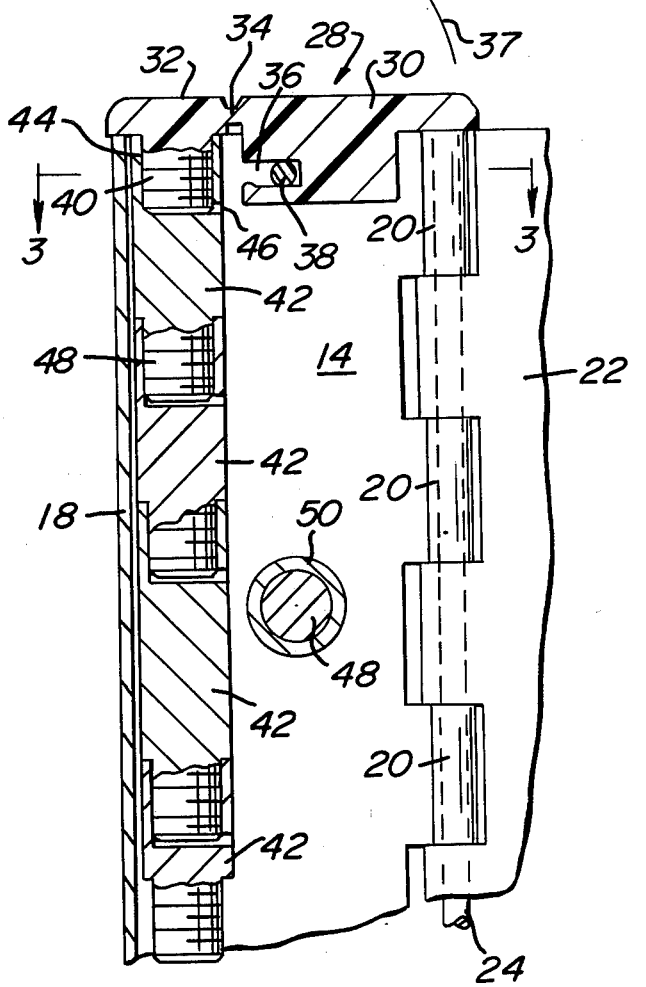
FIG. 2 is a sectional view taken along the line 2—2 in FIG. 1 but on an enlarged scale.
Figure 3:
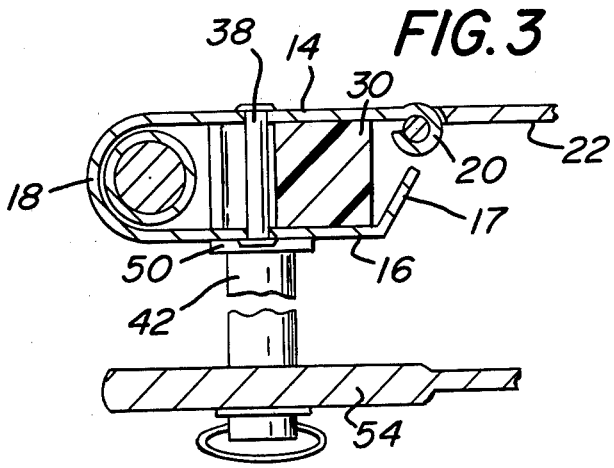
FIG. 3 is a sectional view taken along the line 3—3 in FIG 2.

The housing 12 is closed at its ends by caps 26 and 28. Cap 26 is fixedly secured to the housing in any suitable manner. Cap 28 is removable. As shown more clearly in FIG. 2, the cap 28 includes body portions 30 and 32 interconnected by a web 34. Web 34 acts as a hinge for interconnecting the body portions 30, 32.

The body portion 32 has a slot 36 in a face thereof which extends toward the wall 18. A pin 38 extends between the walls 14 and 16 and preferably is in the form of a rivet. The body 30 and its groove 36 are dimensioned so that body 30 may be pivoted about the web 34 in the direction of arrow 37 to effect disengagement between the cap 28 and the pin 38. Thereafter, the cap 28 is readily removable. Cap 28 is preferably made from a polymeric plastic material which has some flexibility whereby the web 34 may act as a hinge but is generally a hard plastic material.

The end caps 26, 28 conform generally to the cross-sectional shape of the housing 12. Due to the angled wall 17, there is provided a lip portion 39 on the body 30 against which a person's finger may apply pressure in the direction of arrow 37 to remove the cap 28. The lip portion 39 corresponds to the shape of the exposed portion of cap 26 at the lower end of FIG. 1.

The body portion 32 of the cap 28 has a threaded boss 40 on its inner face. A plurality of discrete threaded posts 42 are provided for storage within the housing 12. The posts 42 are identical except for length. Each post 42 includes a threaded hole 44 at one end and a threaded stud 48 at the other end of the same diameter as the hole whereby the posts may be connected to one another end to end. Each post has a transverse hole 46 adjacent the blind end of the threaded hole 44 to vent air when coupling two posts together and to provide means into which a tool may be inserted to loosen or tighten posts.

Hollow inserts or rivets 50, 52 extend between the walls 14, 16 of the housing 12. The riverts 50, 52 have threads on their periphery. At least one of the posts 42 will have its threaded stud 48 coupled to the threads on the inner periphery of the rivets 50, 52. A front cover 54 may be attached to the posts 42 in any conventional manner.

When additional pages must be added to a ledger between the front and rear covers thereof, and the length of the posts are insufficient to accommodate such pages, the following procedure may be used. The front cover 54 is removed. End cap 28 is removed. The number of posts 42 needed are unthreaded from the posts stored within the housing 12. The cap 12 is replaced. The new posts are threaded to the presently existing post so as to increase the capacity of the ledger. Thereafter, the front cover is replaced.

Thus, it will be seen that the present invention involves a binder with a mazazine storage for the posts 42. The posts 42 may be of the same or different lengths. Access to the posts 42 is automatically attained merely by removing the cap 28. The cap 28 is latched in place by the cooperation between slot 36 and pin 38. Since all of the posts are threaded end to end, they do not rattle within the housing 12.

The present invention may be embodied in other specific forms without departing from the spirit or essential attributes thereof and, accordingly, reference should be made to the appended claims, rather than to the foregoing specification as indicating the scope of the invention.

I claim:

1. In a binder the improvement comprising a hollow elongated housing closed at its ends, one end of said housing being closed by a removable cap, a plurality of threaded posts connected end to end in said housing, one of said posts being connected to said cap whereby removal of the cap will facilitate removal of all of the posts therewith.

2. In a binder in accordance with claim 1 wherein said removable cap has two body portions connected together by a web capable of functioning as a hinge, a slot on one of the body portions, a pin on said housing for cooperation with said slot to retain the removable cap in place at one end of said housing, the other body portion being threaded to said one post.

3. In a binder comprising a hollow elongated metal housing closed at its ends, means on a side face of said housing to which a threaded post may be attached, the improvement comprising one end of said housing being closed by a removable cap, means for latching said removable cap to said one end of said housing, a plurality of threaded posts connected end to end, said posts being disposed within said housing and connected to a portion of said cap on the inner surface thereof, and said posts disposed within said housing being adapted to be threaded to said means on said side face of said housing in a disposition perpendicular to said side face.

4. In a binder in accordance with claim 3 wherein said removable cap is made of plastic with two body portions connected together by a hinge.

5. In a binder in accordance with claim 3 wherein the latch means include a slot on a portion of the removable cap and a pin means on the housing, said pin means being received in said slot when said removable cap is attached to said housing.

6. A book having its capacity defined by the length of threaded posts and capable of having its capacity increased by addition of a supplemental threaded post, said book having a hollow binding, the improvement comprising a plurality of supplemental posts threaded end to end, a removable cap closing one end of said binding, said supplemental posts being disposed within said hollow binding, one of the supplemental posts being threaded to said cap on the inner surface thereof.

7. A book in accordance with claim 6 wherein said removable cap is made from plastic and has two body portions connected together by a web capable of acting as a hinge so that one body portion may pivot with respect to the other body portion, cooperating elements on said one body portion and said binding for latching the cap in place, and the other body portion being connected to said supplemental posts within said binding.

* * * * *